US006542126B2

(12) United States Patent
Bahr et al.

(10) Patent No.: US 6,542,126 B2
(45) Date of Patent: Apr. 1, 2003

(54) ANTENNA ARRANGEMENT FOR MOBILE RADIOTELEPHONES

(75) Inventors: Achim Bahr, Viersen (DE); Dirk Manteuffel, Moers (DE); José Marie Baro, Taverny (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/875,870

(22) Filed: Jun. 8, 2001

(65) Prior Publication Data

US 2001/0054979 A1 Dec. 27, 2001

(30) Foreign Application Priority Data

Jun. 23, 2000 (DE) ..... 100 29 733

(51) Int. Cl.[7] ..... H01Q 1/24; H01Q 1/38

(52) U.S. Cl. ..... 343/702; 343/700 MS; 343/846

(58) Field of Search ..... 343/700 MS, 702, 343/895, 846; H01Q 1/24, 1/38

(56) References Cited

U.S. PATENT DOCUMENTS 6,204,819 B1 * 3/2001 Hayes et al. ..... 343/702
6,239,753 B1 * 5/2001 Kado et al. ..... 343/702

FOREIGN PATENT DOCUMENTS

EP 0 623 967 A1 11/1994
EP 0 892 459 A1 1/1999
GB 2316540 A 2/1998
WO WO99/25043 5/1999
WO WO 00/03452 1/2000

OTHER PUBLICATIONS

Patent Abstracts of Japan, Publication No. 06321716, published Dec. 3, 1996, by Iwane Yasushi.

* cited by examiner

*Primary Examiner*—Hoanganh Le
(74) *Attorney, Agent, or Firm*—Sughrue Mion, PLLC

(57) ABSTRACT

A flat antenna arrangement (plate antenna arrangement, patch antenna arrangement) with an earth plate and a radiator that is disposed at a distance essentially parallel to the earth plate and is conductively connected to the latter by one of its end regions, wherein, at a first (lower) resonant frequency of the antenna arrangement, a voltage minimum is present at the connection of the radiator to the earth plate and in the region of the other end (unsupported end) of the radiator a first voltage maximum is present, is characterized in that there is disposed between the radiator (3) and the earth plate (2) near the unsupported end of the radiator (3) a settable switch element (11) that is designed in such a way that it is capable of making a connection having a low impedance, and in that the point at which the switch element is connected to the radiator (3) is disposed in such a way that, with the switch element (11) set to conduct, the radiator (3) has a desired second resonant frequency that is higher than the first resonant frequency. It is advantageous that the entire or almost the entire radiator radiates in the two frequency ranges.

11 Claims, 3 Drawing Sheets

ANTENNA ARRANGEMENT FOR MOBILE RADIOTELEPHONES

BACKGROUND OF THE INVENTION

The invention is based on a priority application (DE 100 29 733.1) which is hereby incorporated by reference. The invention relates to an antenna arrangement (flat antenna arrangement, plate antenna arrangement, patch antenna arrangement) with an earth plate and a radiator that is disposed at a distance essentially parallel to the earth plate and is conductively connected to the latter by one of its end regions, wherein, at a first resonant frequency of the antenna arrangement, a voltage minimum is present at the connection of the radiator to the earth plate and in the region of the other end (unsupported end) of the radiator a first voltage maximum is present.

Built-in antennas for mobile-radio telephones are known that are based on the principle of the patch antenna. The external dimensions of such an antenna module are minimized in existing applications, for example, by using a folded structure (for example, C-patch). In addition to the singly resonant design (a single operating frequency band), further structures are also known that make possible operation in two defined frequency bands (such as, for example, in the two mobile-radio bands of the GSM900 and of the GSM1800 standards). In this case, either two separate radiators are used or the result is achieved by suitable measures that only a certain radiator part is used at the higher operating frequency. These procedures have the disadvantage that the entire available antenna volume is not used, in particular at the higher frequency. This results in a low bandwidth of the antenna.

SUMMARY OF THE INVENTION

The object of the invention is to design an arrangement of the type mentioned at the outset in such a way that it is suitable for two frequency ranges and permits a wide-band structure.

This object is achieved in that there is disposed between the radiator and the earth plate near the unsupported end of the radiator a settable switch element that is designed in such a way that it is capable of making a connection having a low impedance and in that the point at which the switch element is connected to the radiator is disposed in such a way that, with the switch element controlled to conducting, the radiator has a desired second resonant frequency that is higher than the first resonant frequency. An advantage of the invention is that the entire or almost the entire radiator radiates in the two frequency ranges. As a result, a relatively large bandwidth is possible even at the higher frequency because a large radiator surface is available. At the lower frequency, too, there is an advantage because here, again, the entire area available for the antenna in total can be used as radiator. A single point of the radiator can be used for the feed.

One embodiment of the invention provides that the switch element is disposed in such a way that the second resonant frequency corresponds to about twice the first resonant frequency. This ratio of the resonance frequencies is well suited to implementing a mobile telephone for two-band operation, for instance in the GSM900/GSM1800 or GSM900/GSM1900 range.

In one embodiment of the invention, the radiator essentially has the configuration of a C, with the inclusion of an approximately C-shaped form having a non-round, angular shape. This has proved beneficial.

Proceeding from the antenna arrangement described at the outset, the object of designing such an arrangement in such a way that it is suitable for two frequency ranges and permits a broad-band structure is achieved in that the radiator has essentially the shape of a meander or of a plurality of consecutive conductor sections disposed in a zigzag shape, in that, at a further, higher resonant frequency, a voltage minimum or a second voltage maximum, respectively, is present at the said ends of the radiator, and in that such a point of the radiator is capacitively coupled to the earth plate so that the further resonant frequency is reduced with respect to three times the value of the first resonant frequency. This relates to configurations of the radiator that may in the individual case have advantages over a C-configuration. One advantage is that the entire or almost the entire radiator radiates in the two frequency ranges. As a result, a relatively large bandwidth is possible also at the higher frequency because a large radiator surface is available. There is also an advantage at the lower frequency because here, again, the entire area available in total for the antenna can be used as radiator. A single point of the radiation can be used for the feed.

In one embodiment of the invention the radiator has essentially an S-like shape in which three sections extend approximately in the transverse direction of a rectangular surface enclosing the radiator, wherein two sections in each case are connected by a total of two connecting sections. This is a special configuration.

In one embodiment of the invention the capacitance value and the said point of the radiator are chosen in such a way that the first resonant frequency is less strongly reduced than the second resonant frequency. It is advantageous that the antenna can be kept small in its dimensions.

In one embodiment of the invention the capacitance value and the connection of the capacitive coupling are chosen in such a way that the second resonant frequency corresponds, as a rough approximation, to twice the first resonant frequency. The suitability for operation in the 900/1800 MHz or 900/1900 MHz bands is advantageous.

In one embodiment of the invention the said other point of the radiator with which the capacitive coupling takes place is situated in the vicinity of the first voltage maximum on the radiator at the second resonant frequency. A particularly strong reduction in the second resonant frequency with a small reduction in the first resonant frequency is advantageous.

In one embodiment of the invention the said other point is situated approximately at ⅓ of the developed length of the radiator measured from the connection to the earth plate. This is a beneficial dimensioning in many cases.

BRIEF DESCRIPTION OF THE DRAWINGS

The invention also relates to a hand-held radio set, including transceivers, for at least one of the following purposes: speech transmission, data transmission, image transmission, having an antenna, which is characterized in that the antenna is formed by the antenna arrangement according to one of the claims that have essentially been discussed above. It is advantageous that a small type of construction is possible for the appliance.

The invention relates also to use of an antenna arrangement and a design of a hand-held radio set as discussed above. In this connection, according to the invention, only the second (higher) resonant frequency of the antenna arrangement is used in operation. This may result in stock-keeping advantages if only the higher frequency band is needed, but two-band antennas according to the invention are available.

Figure 1:
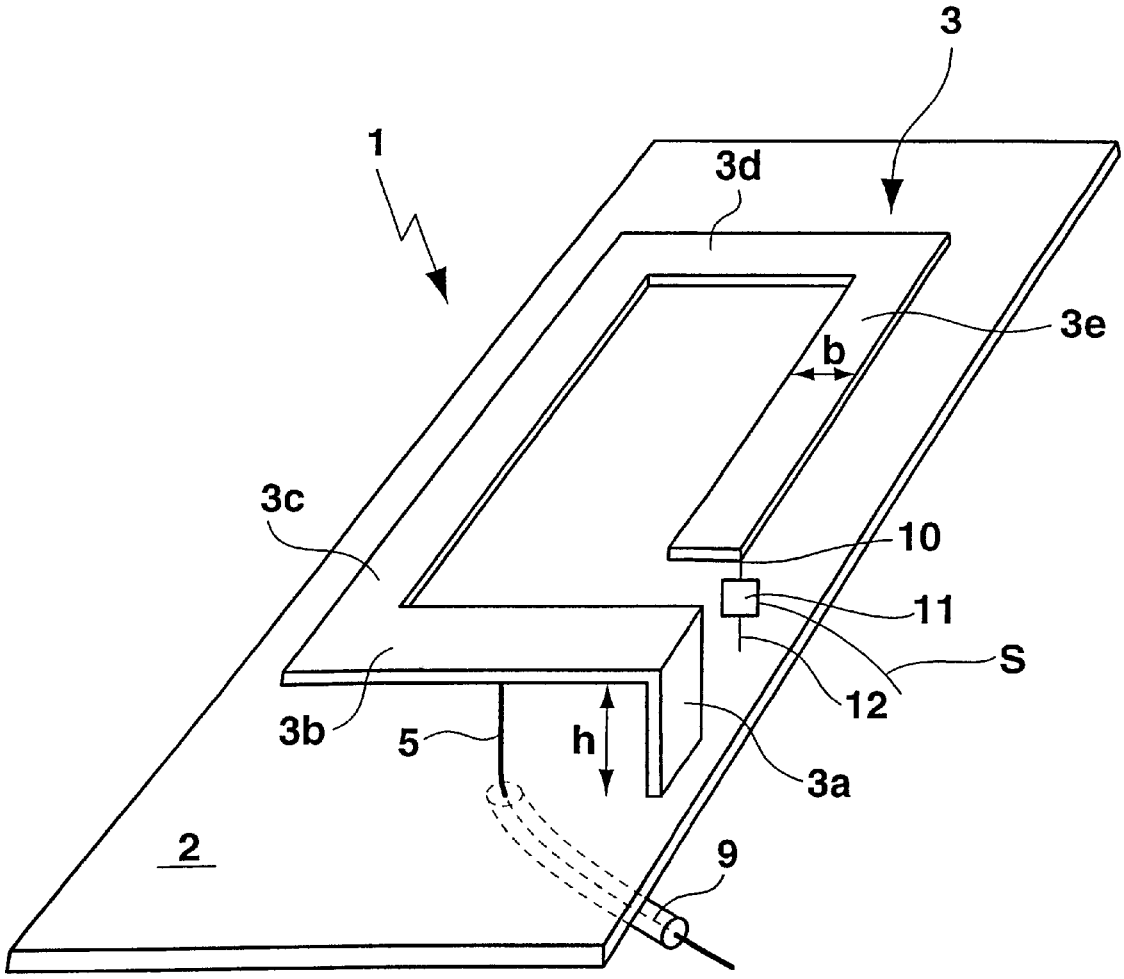
Figure 2:
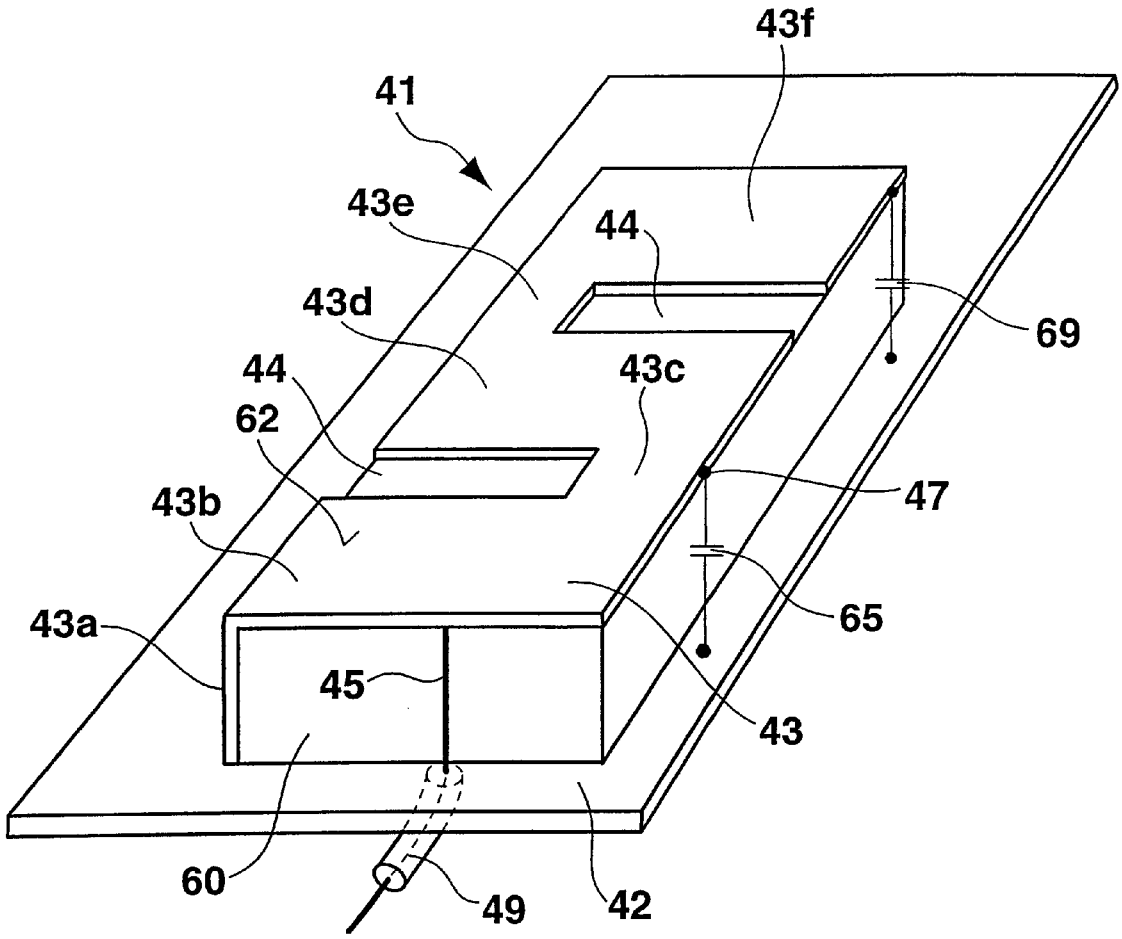
Figure 3:
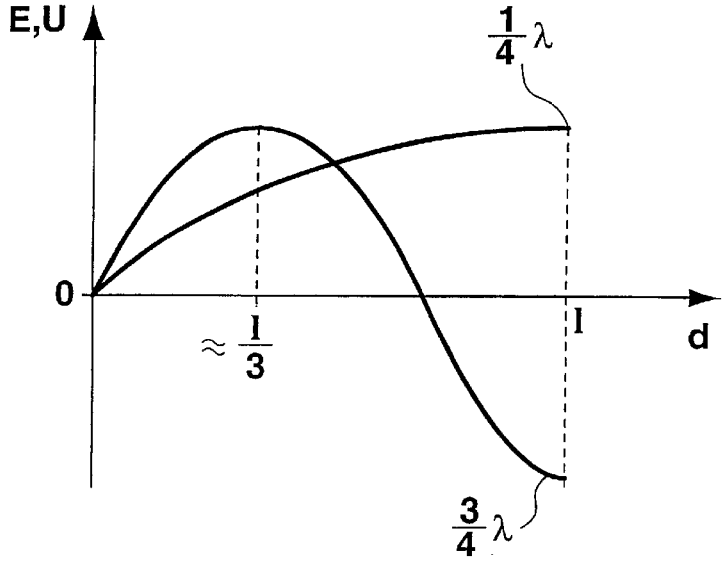
Figure 4:
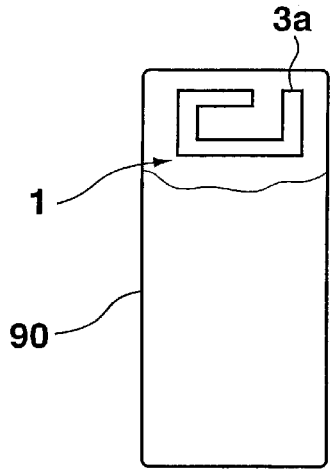
Figure 5:
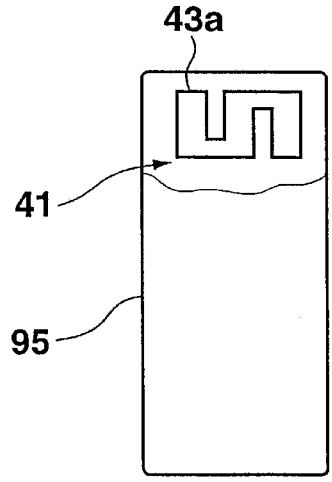

Further features and advantages of the invention emerge from the description below of exemplary embodiments of the invention with reference to the drawing, which shows details essential to the invention, and from the claims. In the drawing:

FIG. 1 shows a diagrammatic perspective view of an antenna arrangement having a switch element, FIG. 2 shows a view of a further antenna arrangement having two capacitors, FIG. 3 shows a graphical representation of the voltage distribution over the length of the radiator of the antenna in accordance with FIG. 2, but without capacitors, at two resonant frequencies, FIG. 4 shows a view of a hand-held radiotelephone set having an antenna according to FIG. 1, FIG. 5 shows a view of a hand-held radiotelephone set having an antenna according to FIG. 2.

In FIG. 1, the antenna arrangement 1 has an earth plate 2. In the example the latter is flat. A radiator 3 is disposed at a distance from the earth plate 2 parallel to the earth plate 2 over most of its length and held at a constant distance from the earth plate 2 by means not shown.

In a first exemplary embodiment that was implemented in FIG. 1, said means are a few spacers made of insulating material disposed between the radiator 3 and the earth plate 2. In another exemplary embodiment, the said means are a plate of dielectric material disposed between the radiator 3 and the earth plate 2.

The radiator 3 is in total multiply angled. One end of that part of the radiator 3 that extends parallel to the earth plate 2 is connected by a section 3*a* (short-circuit plate) that extends at right angles to the earth plate 2 is conductively connected over its entire width to the earth plate 2. Adjacent to the section 3*a* is a section 3*b* of the radiator 3, adjacent to the section 3*b* and extending at right angles to it is a section 3*c* that extends parallel to a longitudinal edge of the earth plate 2, which is rectangular in the example, a section 3*d* adjoins the latter parallel to the section 3*b*, and adjacent to the section 3*d* is a section 3*e* extending at a distance from the section 3*c* and parallel to it. The sections 3*b* to 3*d* form in total approximately the shape of a letter C. The unsupported end of the section 3*e* is close to the short-circuit plate 3*a*. The sections 3*b* to 3*e* form a flat, angular, spiral-like arrangement. The antenna shown can also be described as a flat antenna, plate antenna or patch antenna.

The entire radiator 3 having the said sections 3*a* to 3*e* is made, in one embodiment of the invention, integrally from a thin metal sheet by punching or bending. In another embodiment, the radiator is applied as metallization to the top side and a peripheral area of the abovementioned insulating plate of dielectric material.

The radiator 3 is fed in the transmitting and receiving case via a feedline 5 that is disposed at a distance from the short-circuit plate 3*a* and is connected to the radiator 3 (to the section 3*b* in the example), the distance being chosen in such a way as to produce a desired wave impedance for the feed. Since a relatively low wave impedance is generally desired (in the order of magnitude of 50 ohm), the feedline 5 is relatively close to the short-circuit plate 3*a* compared with the entire developed length of the radiator 3.

The height h that corresponds to the length of the short-circuit plate 3*a* and at which most of the radiator 3 is situated above the earth plate 2 is small compared with a quarter of the wavelength of the high frequency with which the antenna arrangement 1 is to be operated.

The abovementioned low-impedance feed of the feedline 5 is symbolized in FIG. 1 by a coaxial cable 9 that is brought up to the earth plate 2 from below. The outer conductor of the coaxial cable 9 is connected to the conducting visible surface of the earth plate 2 and the centre conductor of the coaxial cable 9 is connected to the feedline 5.

In the practical application, the coaxial cable 9 will frequently be very much shorter than shown or the coaxial cable may possibly be dispensed with entirely because the electronic circuit to be connected to the antenna arrangement 1 is situated in embodiments of the invention directly underneath the earth plate 2. In further embodiments of the invention, the earth plate 2 is formed by the largely continuous metallization of a printed circuit board on whose lower side the circuit components of a printed circuit are situated.

In the embodiment according to FIG. 1, the radiator 3 has, insofar as the antenna arrangement has hitherto been described, a first resonant frequency at which the length l of the radiator corresponds to a quarter of the wavelength. For the purpose of simplification, deviations in the length due to the permittivity of one of the abovementioned insulating plates are not dealt with here.

In order to be able to use the antenna arrangement also at a higher frequency than in the region of the said first resonant frequency, there is inserted between a point 10 on the radiator 3 and a closely adjacent point 12 on the earth plate 2 a settable (in the example, electronic) switch arrangement 11 that can be switched over between a turned-off state in which it does not allow high frequency to pass and a "conducting" state in which it allows high frequency to pass. The last mentioned state does not have to denote a direct-current connection. The point 10 is situated near the unsupported end of the radiator 3. In the example, the point 10 is at the unsupported end of the section 3*e*. A control connection of the switch element shown is denoted by the reference symbol S.

If the switch element 11 is in the high-frequency-transmitting state, the said unsupported end of the radiator is virtually short-circuited to earth and the radiator consequently resonates at a higher resonant frequency $f_2$ at which the radiator length corresponds to half the wavelength. In this case, the frequencies of the lower and of the second (higher) resonant frequency are in a ratio of about 1:2 in the example of FIG. 1.

A precise setting of the upper resonant frequency may require a positioning of the switch element at a small distance from the radiator end. According to the invention, however, this distance is small in order also to use the entire available radiator area at the higher resonant frequency.

Whereas the radiator is essentially a $\lambda/4$ radiator over a conductive plane at the low resonant frequency, the antenna arrangement may be regarded at the said higher resonant frequency as a loop antenna in which the said loop is formed by the radiator, the earth plate situated underneath it and the two conducting connections between the radiator and the earth plate at the two ends of the radiator.

With regard to the configuration of the radiator, as it is to be perceived in the plan view (approximately a C-shaped configuration in the example of FIG. 1), modifications are possible without departing from the scope of the invention.

Any suitable switch element can be used as electronic switch element. In embodiments of the invention, a pin diode or a transistor is provided. In selecting the switch element, the voltage that prevails across it in the case of a nonconducting switch element, on the one hand, and the current that flows through it in the case of a conducting switch element, on the other hand, have to be taken into account. The said electronic elements furthermore require circuitry that may comprise capacitors, resistors and a high-frequency choke and is familiar to the person skilled in the art per se.

In the embodiment according to FIG. 2, an antenna arrangement 41 has an earth plate 42 on which there is disposed a plastic plate 60 that carries a metallization 62. The latter forms the radiator 43 that is formed on the surface of said plastic plate, and the short-circuit plate 43*a* that belongs to the radiator and that is disposed on a surface of the plastic plate extending at right angles to the top side and is conductively connected to the earth plate 42.

In another embodiment, the radiator is made integrally from a thin metal sheet by punching and bending. The distance between the radiator and the earth plate is in this case ensured by individual spacers made of insulating material.

In the transmitting and receiving case, the radiator 43 is fed via a feedline 45 that is disposed at a distance from the short-circuit plate 43*a* and is connected to the radiator 43 (the section 43*b* in the example), the distance being chosen in such a way as to result in a desired wave impedance for the feed. Since a relatively low wave impedance is generally desired (in the order of magnitude of 50 ohm), the feedline 45 is situated relatively closely to the short-circuit plate 43*a* compared to the entire developed length of the radiator 43.

The height h, which corresponds to the length of the short-circuit plate 43*a* and at which most of the radiator 43 is situated above the earth plate 42, is small compared with a quarter of the wavelength of the high frequency with which the antenna arrangement 41 is to be operated.

The abovementioned, low-impedance feed of the feedline 45 is symbolized in FIG. 2 by coaxial cable 49 that is brought up to the earth plate 42 from below. The outer conductor of the coaxial cable 49 is connected to the conductive, visible surface of the earth plate 42 and the centre conductor of the coaxial cable 49 is connected to the feedline 45.

The configuration of the radiator 43 as it is shown in plan view has essentially the shape of an S or of a meander. For this purpose, that part of the radiator 43 adjacent to the short-circuit plate 43*a* comprises a wide, long region 43*b* to which a short narrow region 43*c* is adjacent, which is again followed by a long wide region 43*d*, and this is followed by a short narrow region 43*e* and, finally, by a long wide region 43*f*. The regions 43*b*, 43*d* and 43*f* are each of the same size, and the regions 43*c* and 43*e* are also mutually equal. The meander shape is formed by two slots 44 that penetrate into a rectangle from two sides. The wide regions each have a low inductance per unit length, while the narrow regions have a greater inductance per unit length.

At the desired lower resonant frequency, the developed length l of the radiator, measured from the connection point between the short-circuit plate 43*a* and the earth plate 42 to the unsupported end, corresponds approximately to a quarter of the wavelength at said lower resonant frequency. The developed length is somewhat shorter than the length that results if the length is measured in each case precisely in the centre of the individual sections of the radiator.

The radiator is in $\lambda/4$ resonance at a lower resonant frequency, but the measured length of the radiator can only be brought in line with the said length $\lambda/4$ at the lower resonant frequency by taking into account the permittivity of the plastic plate. In the embodiment according to FIG. 2, operation of the antenna arrangement is possible in various frequency bands.

If the radiator 43 is initially considered only in connection with the earth plate 42, that is to say ignoring the capacitive elements connected to the radiator, the arrangement has a first resonant frequency at which the length of the radiator corresponds approximately to a quarter of the wavelength, and a next-higher resonant frequency at which the length of the radiator corresponds to ¾ of the wavelength of the higher resonant frequency.

This is shown in FIG. 3. At the two said resonant frequencies, there is a voltage minimum at the short-circuit end of the radiator and a voltage maximum at the unsupported end of the radiator. Such an arrangement cannot be used in this form if the antenna arrangement is to be operated in two frequency ranges that differ very roughly by the factor 2, as is required, for example, in the ranges GSM900 and GSM1800, on the one hand, or GSM900 and GSM1900, on the other hand, for mobile telephones (mobile-radio telephones) or portable telephones. In accordance with the embodiment of the invention shown in FIG. 2, a capacitor 65 is therefore inserted between a point 47 on the radiator 43, which is situated at a distance of approximately ⅓ of the radiator length measured from the connection between the short-circuit plate 43*a* and the earth plate 42, and the earth plate.

As FIG. 3 reveals, there is present at said capacitor, which is permanently connected to the circuit, that is to say is not switchable, in the case of $\lambda/4$ resonance a lower voltage than in the case of $3/4\lambda$ resonance, assuming the same high frequency amplitude in both cases. Said capacitor therefore influences, at the lower resonant frequency, the antenna arrangement less than at the higher resonant frequency. This arrangement is therefore suitable for changing the originally present frequency ratio 1:3 between the two resonant frequencies so as to result, for example, as in the case just mentioned for GSM radiotelephones, approximately in a ratio of 1:2. The low capacitive loading effected also at the low resonant frequency can be taken into account in designing the antenna arrangement by making the entire radiator initially somewhat shorter than would have to be the case without the presence of the capacitor at the low resonant frequency.

In the case of the embodiment of the invention shown in FIG. 2, a capacitor 69 is also connected at the unsupported end of the radiator 43 between the latter and the earth plate. The capacitor 69 is also operative at the lower resonant frequency or during operation in the lower frequency band (GSM900 in the above example). In this connection, care must be taken that the capacitance value of the capacitor is chosen to be so low that excessive currents do not flow during operation of the lower frequency band, which currents could decrease the lower resonant frequency of the antenna arrangement in a troublesome manner.

The connections for the capacitors 65 and 69 are provided in the region of the same edge of the radiator 43 or of the plastic plate 60, respectively. The size of the capacitor at the unsupported end of the radiator 43 is such that, at the higher resonant frequency, a certain high-frequency current still flows via said capacitor so that the unsupported end of the adjacent part of the radiator contributes to the radiation of a high frequency and to the reception. If the unsupported end were left completely free, the high-frequency currents flowing in its vicinity would possibly be very much smaller (depending on the specific construction and operating details) so that the radiator would hardly any longer be operative in the said end region during operation in the higher resonant frequency range. This would have the result that less radiator area is operative in total at the higher resonant frequency or in its vicinity and this could reduce the bandwidth of the antenna arrangement in an undesirable manner. As large a bandwidth as possible is desirable, for example, because the radiation of the antenna could be influenced by the hand holding the mobile telephone.

On the other hand, the transmitting and receiving on a band (for example, GSM1800) does not take place at the same frequency but in two subbands that are separated from one another by a gap, in which case it is intended at least to achieve the object that, within the transmitting band, on the one hand, and, within the receiving band, on the other hand, a large enough bandwidth is available to manage with as few as possible switchover operations as a function of the transmission frequency actually used in each case and correspondingly as a function of the respective receiving frequency. Different adjustments are necessary for the transmission band, on the one hand, and the receiving band, on the other hand, because the bandwidth for these two operating modes is inadequate. The invention makes no change to this, but it provides a structure that is relatively wide-band within the transmitting band, on the one hand, and within the receiving band, on the other hand.

Measured along the radiator 43 of FIG. 2, the distance between the connection of the capacitor 65 to the radiator and of the capacitor 69 to the radiator at the higher resonant frequency is approximately $\lambda/2$. The air-line distance between said two connections is very much shorter.

In the arrangement according to FIG. 2, the meander-shaped or S-shaped configuration of the radiator furthermore has the advantage that both the capacitor 65 and the capacitor 69 can be connected in the vicinity of an edge of the upper side of the plastic plate 60 to the radiator 43. In this connection, it may be expedient to bring the metal layer forming the radiator up to the edge of the upper surface of the plastic plate 60 to make the connecting points or, possibly, to bring them also over the edge somewhat downwards in the direction of the earth plate 42.

FIG. 4 shows, in a simple view, a partially broken-away hand-held radio set 90, namely a mobile-radio telephone, that contains the abovedescribed antenna arrangement 1 of FIG. 1 as antenna. The short-circuit plate 3*a* is disposed towards the upper end of the housing of the radiotelephone. The hand-held radio set is designed in the example for the GSM900 and GSM1800 ranges. The antenna arrangement is completely accommodated in the interior of the housing of the radiotelephone and is consequently a built-in antenna.

FIG. 5 shows, in a simple representation, a partially broken-away hand-held radio set 95, namely a mobile-radio, telephone that contains the abovedescribed antenna arrangement 41 of FIG. 2 as antenna. The short-circuit plate 43*a* is disposed towards the upper end of the housing of the radiotelephone. The hand-held radio set is designed in the example for the ranges GSM900 and GSM1800. The antenna arrangement is completely accommodated in the interior of the housing of the radiotelephone and is consequently a built-in antenna.

In special exemplary embodiments of the antenna arrangements according to FIGS. 1 and 2 for a radio telephone for the GSM900 and GSM1800 ranges, the radiator occupies a space of about 5 cm×4 cm×0.5 cm (the latter is the length of the short-circuit plate).

It is to be emphasized that, in all the exemplary embodiments, the antenna arrangement is fed for the two frequency bands at the same circuit point, namely at the connecting point of the feedline 5 or 45, respectively, to the radiator.

The frequency ranges are at approximately 880 to 960 MHz for GSM900, at approximately 1710 to 1880 MHz for GSM1800 and at approximately 1850 to 1990 MHz for GSM1900.

What is claimed is:

1. An antenna arrangement comprising:

an earth plate;

a radiator that is disposed at a distance substantially parallel to the earth plate and having a first end that is conductively connected to the earth plate and a second end that is displaced from the earth plate, wherein, at a first resonant frequency of the antenna arrangement, a voltage minimum is present at the first end of the earth plate, and a first voltage maximum is present at the second end;

a settable switch element disposed between the radiator and the earth plate at a position proximate the second end for making a connection having a low impedance, wherein the point at which the switch element is connected to the radiator is disposed in such a way that, with the switch element set to conduct, the radiator has a desired second resonant frequency that is higher than the first resonant frequency.

2. The antenna arrangement according to claim 1, wherein the switch element is disposed in such a way that the second resonant frequency corresponds to about twice the first resonant frequency.

3. The antenna arrangement according to claim 1, wherein the radiator essentially has the configuration of a C.

4. The antenna arrangement according to claim 1, wherein a feed of the antenna arrangement for a plurality of frequency bands is provided at one connection to the radiator.

5. A flat antenna arrangement comprising:

an earth plate and a radiator that is disposed at a distance substantially parallel to the earth plate and is conductively connected to the earth plate at a first end region of the radiator, wherein, at a first resonant frequency of the antenna arrangement, a first voltage minimum is present at the connection of the radiator to the earth plate and in a second end region of the radiator a first voltage maximum is present, wherein the radiator has a plurality of consecutive conductor sections disposed in a zigzag shape and wherein, at a second higher resonant frequency, a second voltage minimum and a second voltage maximum, respectively, are present at said first and second end regions of the radiator, and in that such a point of the radiator is capacitively coupled to the earth plate so that the second resonant frequency is reduced with respect to three times the value of the first resonant frequency.

6. The flat antenna arrangement according to claim 5, wherein the radiator has essentially an S-like shape in which three sections extend approximately in the transverse direction of a rectangular surface enclosing the radiator, wherein two sections in each case are connected by a total of two connecting sections.

7. The flat antenna arrangement according to claim 5, wherein the capacitance value and the point of the radiator are chosen in such a way that the first resonant frequency is less strongly reduced than the second resonant frequency.

8. The flat antenna arrangement according to claim 5, wherein the capacitance value and the connection of the capacitive coupling are chosen in such a way that the second resonant frequency corresponds, as a rough approximation, to twice the first resonant frequency.

9. The flat antenna arrangement according to claim 5, wherein the point of the radiator with which the capacitive coupling takes place is situated in the vicinity of the first voltage maximum on the radiator at the second resonant frequency.

10. The flat antenna arrangement according to claim 9, wherein the said point is situated approximately at ⅓ of the developed length of the radiator measured from the connection to the earth plate.

11. The flat antenna arrangement according to claim 5, wherein a further capacitive coupling to the earth plate is provided at the unsupported end of the radiator.

* * * * *